US006589607B1

(12) United States Patent
Edwards et al.

(10) Patent No.: US 6,589,607 B1
(45) Date of Patent: Jul. 8, 2003

(54) METHOD OF COATING A CONTINUOUSLY MOVING SUBSTRATE WITH THERMOSET MATERIAL AND CORRESPONDING APPARATUS

(75) Inventors: Douglas E. Edwards, Chicago, IL (US); Mark R. Monterastelli, Chicago, IL (US)

(73) Assignee: Material Sciences Corporation, Elk Grove Village, IL (US)

( * ) Notice: Subject to any disclaimer, the term of this patent is extended or adjusted under 35 U.S.C. 154(b) by 0 days.

(21) Appl. No.: 09/605,821

(22) Filed: Jun. 29, 2000

(51) Int. Cl.[7] ..... B05D 1/06; B05D 3/02

(52) U.S. Cl. ..... 427/475; 427/477; 427/485; 427/486; 427/374.4; 427/374.2; 427/379

(58) Field of Search ..... 427/475–486, 427/470, 471, 314, 316–330, 374.2, 374.3, 374.4, 379

(56) References Cited

U.S. PATENT DOCUMENTS 5,059,446 A * 10/1991 Winkle, Sr. et al.
5,121,406 A 6/1992 Hugo ..... 373/142
5,156,683 A 10/1992 Ross ..... 118/620
5,439,704 A 8/1995 Sankaran et al. ..... 427/195
5,469,461 A 11/1995 Andrea ..... 373/156
5,472,528 A 12/1995 Boyer ..... 148/567
5,578,233 A 11/1996 Arvedi et al.
5,695,826 A 12/1997 Escallon ..... 427/477
5,769,276 A 6/1998 Alexander ..... 222/148
5,901,170 A 5/1999 Peysakhovich et al. ..... 373/155

* cited by examiner

*Primary Examiner*—Fred J. Parker
(74) *Attorney, Agent, or Firm*—Liniak, Berenato & White, LLC

(57) ABSTRACT

A method and apparatus for coating sheet material with thermoset material. In certain embodiments, first and second different induction furnaces are provided, with the coated sheet first proceeding into and through the first furnace, and then into and through the second furnace. The first furnace may be maintained at a temperature less than the second furnace, so that out-gassing of volatile materials is achieved in the first furnace and thereafter heightened cross-linking conversation rates are achieved in the second furnace at higher temperature(s).

13 Claims, 8 Drawing Sheets

| # | Parameter | Value |
|---|---|---|
| 0 | lg A1/s^-1 | 10.5542 |
| 1 | E1 kJ/mol | 91.0571 |
| 2 | React.ord. 1 | 1.3255 |
| 3 | lg A2/s^-1 | 6.6214 |
| 4 | E2 kJ/mol | 71.4395 |
| 5 | React.ord. 2 | 0.8880 |
| 6 | FollReact. 1 | 5.30E-03 |

| # | Parameter | Value |
|---|---|---|
| 0 | lg A1/s^-1 | 10.5542 |
| 1 | E1 kJ/mol | 91.0571 |
| 2 | React.ord. 1 | 1.3255 |
| 3 | lg A2/s^-1 | 6.6214 |
| 4 | E2 kJ/mol | 71.4395 |
| 5 | React.ord. 2 | 0.8880 |
| 6 | FollReact. 1 | 5.30E-03 |

| # | Parameter | Value |
|---|---|---|
| 0 | lg A1/s^-1 | 10.5542 |
| 1 | E1 kJ/mol | 91.0571 |
| 2 | React.ord. 1 | 1.3255 |
| 3 | lg A2/s^-1 | 6.6214 |
| 4 | E2 kJ/mol | 71.4395 |
| 5 | React.ord. 2 | 0.8880 |
| 6 | FollReact. 1 | 5.30E-03 |

| # | Parameter | Value |
|---|---|---|
| 0 | lg A1/s^-1 | 10.5542 |
| 1 | E1 kJ/mol | 91.0571 |
| 2 | React.ord. 1 | 1.3255 |
| 3 | lg A2/s^-1 | 6.6214 |
| 4 | E2 kJ/mol | 71.4395 |
| 5 | React.ord. 2 | 0.8880 |
| 6 | FollReact. 1 | 5.30E-03 |

METHOD OF COATING A CONTINUOUSLY MOVING SUBSTRATE WITH THERMOSET MATERIAL AND CORRESPONDING APPARATUS

This invention relates to a method of applying a coating onto a substrate, and a corresponding apparatus. More particularly, this invention relates to utilizing first and second rapid and selective heating zones to efficiently provide a high gloss coating on continuously moving sheet, strip or blank material.

BACKGROUND OF THE INVENTION

Liquid roller coating lines are known in the art, and may apply solvent or water-based paints/coatings to metal strip through the use of roller-coating machines. Unfortunately, environmental regulations have made such coating lines undesirably expensive in view of the need for solvent containment and incineration systems. Additionally, there is a finite limit to the thickness of a coating that can be effectively applied using such systems.

Accordingly, powder coating of strip material has been developed in the industry. This normally involves applying electrostatically charged dry plastic powder to a strip, and then passing the strip with powder thereon through a convection oven where the powder is melted and cured through a cross-linking process. An example of a powder-coating system is disclosed in U.S. Pat. No. 5,439,704, the disclosure of which is hereby incorporated herein by reference. Reference is also made to FIG. 1 herein, taken from the '704 patent.

As shown in FIG. 1 of the '704 patent, the powder-coating system includes input region 1, powder-coating booth 3, heating chamber 5, quench 7, and output region 9. When metal strip 11 is being processed, it is suspended through booth 3 and oven 5 between a pair of entrance rolls 13 and catenary roll 15. After the powder-coated strip 11 exits booth 3, the strip enters oven 5. The thermoset powder material on strip 11 melts and cures into a coating. The curing phase involves cross-linking of molecular chains of the thermoset plastic to form the final hardened material. In one example discussed in the '704 patent, a polyester hybrid powder coated strip is held within oven 5 for approximately 25–30 seconds at a temperature of 475° F.

Unfortunately, conventional heating processes have been found to be undesirable for a number of reasons. Additionally, when gasses within the thermoset material are not permitted to exit prior to curing, the finished product may suffer from the "orange peel effect", thus having a mottled surface (i.e. bumpy surface). This may occur when the powder-coated metal strip is heated at too fast a rate to too high a temperature. It has also been found that convection ovens are not particularly well suited for precisely controlling thermoset-coated material temperatures. Convection ovens also suffer from excessive dirt problems.

In view of the above, it is apparent that there exists a need in the art for an improved method for coating continuously moving strip (e.g. coil steel, coil aluminum, fabric, blanks, etc.) with thermoset material. There also exists a need in the art for an improved method of heating and/or curing thermoset material, so as to result in a superior finished product. It is a purpose of this invention to fulfill any and/or all of the above-described needs in the art, as well as other needs which will become apparent to the skilled artisan from the following detailed description of this invention.

SUMMARY OF THE INVENTION

It is an object of this invention to provide an efficient method of coating continuously moving sheet, strip or blank material with thermoset material.

Another object of this invention is to utilize first and second adjacent rapid response ovens/furnaces in order to efficiently heat and cure thermoset material coated onto continuously moving material, and the ovens may preferably include induction ovens and Infrared ovens that have a rapid response permitting precise selection and control over heating of the thermoset material.

Another object of this invention is to provide an efficient method and apparatus for coating steel, aluminum, other types of metal, fabric, and the like with thermoset material to a desired thickness.

Another object of this invention is to heat thermoset powder material applied to a continuously moving substrate in a manner such that the resulting coated (e.g. painted) product has high gloss.

Another object of this invention is to provide a method of coating a moving substrate with thermoset powder, heating the coated substrate to a first temperature, and thereafter heating the coated substrate to a second higher temperature in order to obtain a superior final coated product.

Still another object of this invention is to fulfill any and/or all of the above-listed objects.

This invention further fulfills any or all of the above described needs and/or objects by providing a method of making a coated article comprising the steps of:

- electrostatically applying a thermoset powder coating onto at least one major surface of a continuously moving substrate and thereby providing a thermoset coated substrate;
- moving the thermoset coated substrate into a first induction oven and heating the substrate and thermoset powder coating thereon to a first temperature in the first induction oven sufficient to substantially melt the thermoset powder;
- moving the thermoset coated substrate from the first induction oven into a second induction oven and heating the substrate and thermoset coating thereon to a second temperature in the second induction oven sufficient to effect substantial cross linking of the thermoset, wherein the second temperature is higher than the first temperature; and
- moving the substrate with cured thermoset coating thereon from the second induction oven to a quenching area for quenching.

This invention will now be described with respect to certain embodiments thereof, along with reference to the accompanying illustrations.

BRIEF DESCRIPTION OF THE DRAWINGS

FIG. 3(*b*) is a side cross-sectional view of the coated substrate of FIG. 3(*a*) after it has undergone heat processing according to certain embodiments of this invention.

DETAILED DESCRIPTION OF CERTAIN EMBODIMENTS OF THIS INVENTION

Figure 1:
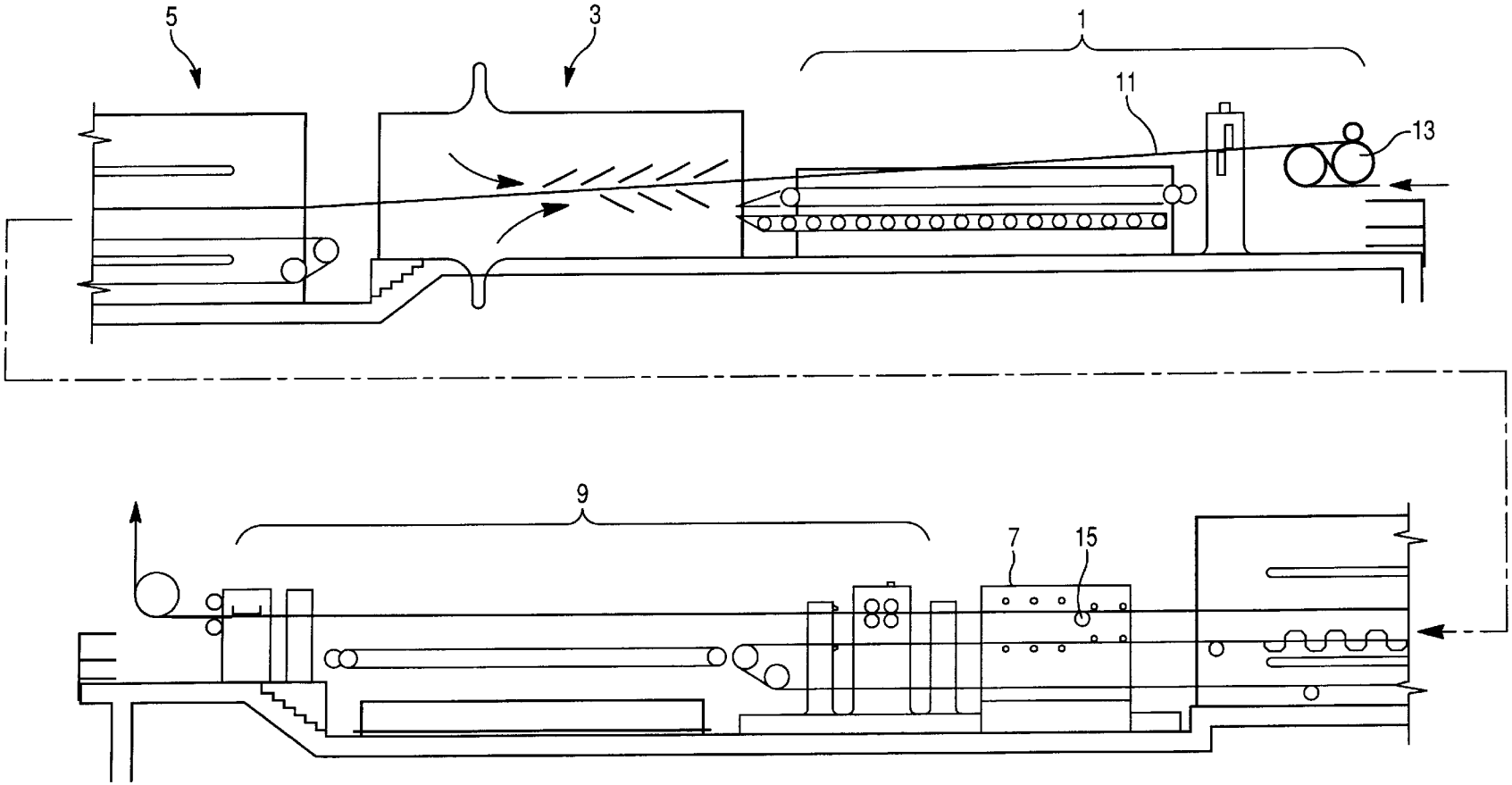
Fig. 1 Prior Art
FIG. 1 is a side elevational view of a known powder-coating system.

Referring now more particularly to the accompanying drawings in which like reference numerals indicate like parts throughout the several views.

Figure 2:
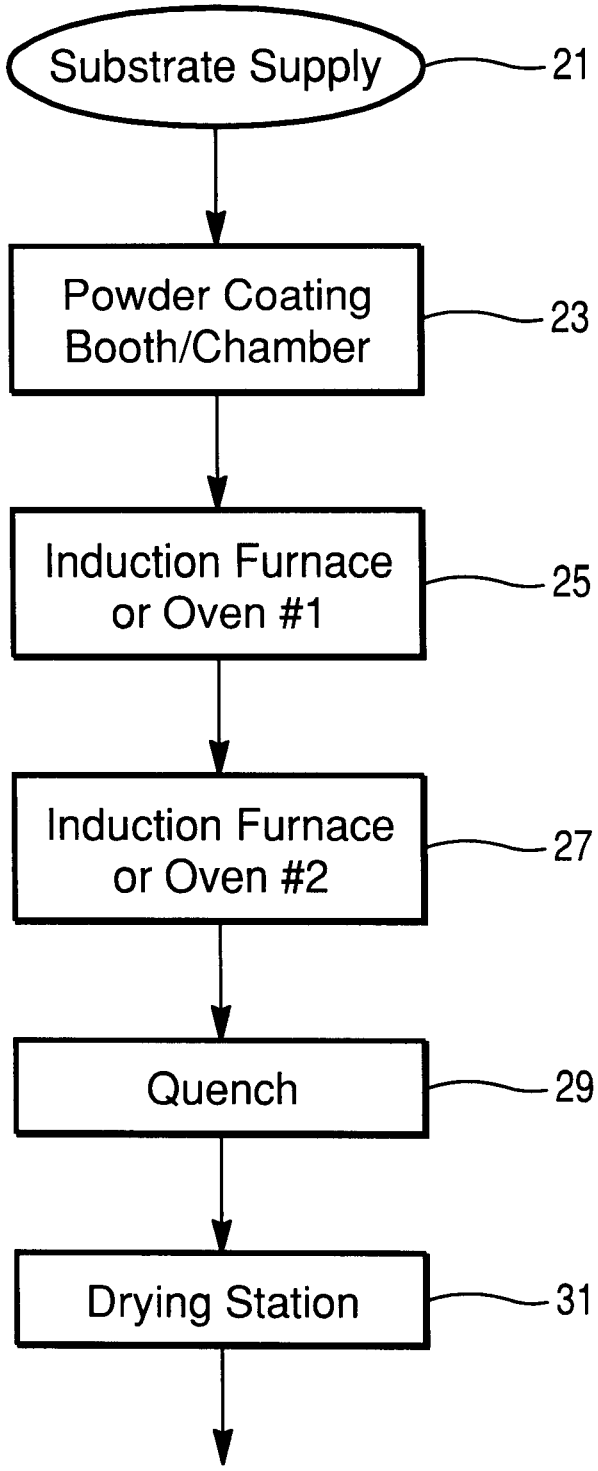
FIG. 2 is a flow chart illustrative of an embodiment of this invention.

FIG. 2 is a flow chart illustrating how a coated product of sheet, strip, or blank form is manufactured according to an embodiment of this invention. Initially, a roll of strip material (e.g. steel, aluminum, other metal, fabric, wood, etc.) may be provided at 21. A conveyor forwards the sheet/strip along a conveyor through a powder-coating booth or chamber 23. Inside chamber 23, thermoset powder material is electrostatically deposited onto at least one major surface of the sheet. Such powder may be electrostatically deposited in any manner described in any of U.S. Pat. Nos. 5,769,276; 5,695,826; and/or 5,439,704, the disclosures of which are all hereby incorporated herein by reference. An exemplary thermoset powder material which may be deposited onto the sheet in chamber 23 is model Rouge msc BBF5 SG106/1, available from Herberts Bichon SA, located in France.

After leaving powder-coating chamber 23, the continuously moving coated strip is forwarded to first induction furnace/oven 25 that defines heating zone #1. First oven 25 heats the underlying sheet and thermoset coating to temperature(s) sufficient to melt the thermoset powder coating. At this temperature, volatile materials such as water, powder components, and reactionary gases are driven off. From oven 25, the strip is forwarded to adjacent second induction furnace/oven 27 that defines heating zone #2. The distance between ovens 25 and 27 should be sufficient to permit the volatile materials to be evacuated or degassed prior to the coated article entering the second oven. In second induction oven 27, the underlying sheet and thermoset coating is heated to second higher temperature(s) in order to effect curing of the coating. In certain embodiments, the sheet is heated to a temperature in the second oven at least about 10° C. higher than in the first oven, preferably at least about 20° C. higher. It is noted that the terms oven and furnace are used interchangeably herein. We prefer that the ovens 25 and 27 be able to rapidly respond to demands that may be placed upon them in order to heat the substrate and thereby the powder to a temperature selected to achieve the result being sought; i.e., melt the powder or cross-link the degassed molten powder. We prefer induction ovens for the ovens 25 and 27, although certain infrared ovens may be used in certain instances.

After leaving second oven 27, the coated sheet enters quenching chamber or zone 29 in which the sheet/strip is sprayed with water or the like in order to rapidly cool it. In certain embodiments, quench 29 includes an outer housing supporting a plurality of nozzle inclusive headers (e.g. see FIG. 1) that direct cooling spray toward the hot, coated sheet. In alternative embodiments, the coated sheet may be air quenched. In quench zone 29, the temperature of the coated sheet is reduced to from about 100°–120° F. Following quench 29, the cooled coated sheet is forwarded to drying station 31 where the strip is blown dry with air knives/nozzles or the like. The resulting product is a sheet (e.g. steel sheet) coated (e.g. painted) with thermoset material (e.g. see FIG. 3(*b*)).

Figure 3A:
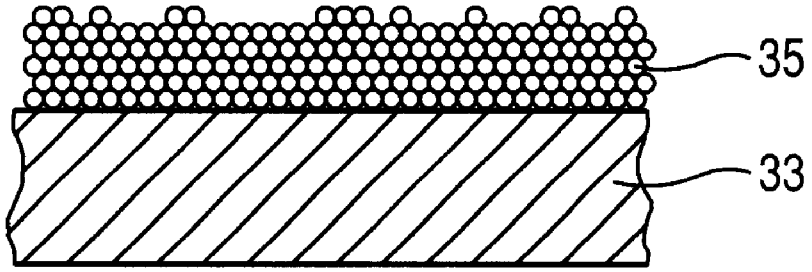
FIG. 3(*a*) is a side cross-sectional view of a substrate (e.g. coil steel) initially coated with thermoset powder material, prior to heating, according to an embodiment of this invention.
Figure 3B:
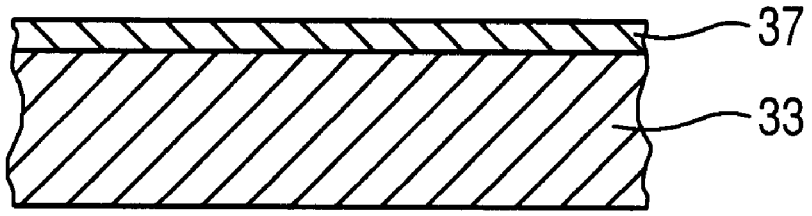

FIG. 3(*a*) illustrates an exemplar metal sheet 33 provided with a coating of thermoset powder material 35 thereon. The coated product appears as in FIG. 3(*a*) when it leaves coating chamber 23, but before it reaches first induction furnace 25. After being heated and cured, the coated metal sheet product which exits second induction furnace 27 appears as shown in FIG. 3(*b*), including cured thermoset coating 37 provided on at least one major surface of underlying sheet 33. Referring to FIGS. 3(*a*) and 3(*b*), thermoset powder coating 35 prior to heating may be from about 10–500 $\mu$m thick (preferably about 200–300 $\mu$m thick). However, the coating thins during the heating process, so that final cured coating 37 is of a much lesser thickness than original powder-coating 35. Final cured coating 37 may have a thickness of from about 5–80 $\mu$m, most preferably from about 30–50 $\mu$m.

Figure 4:
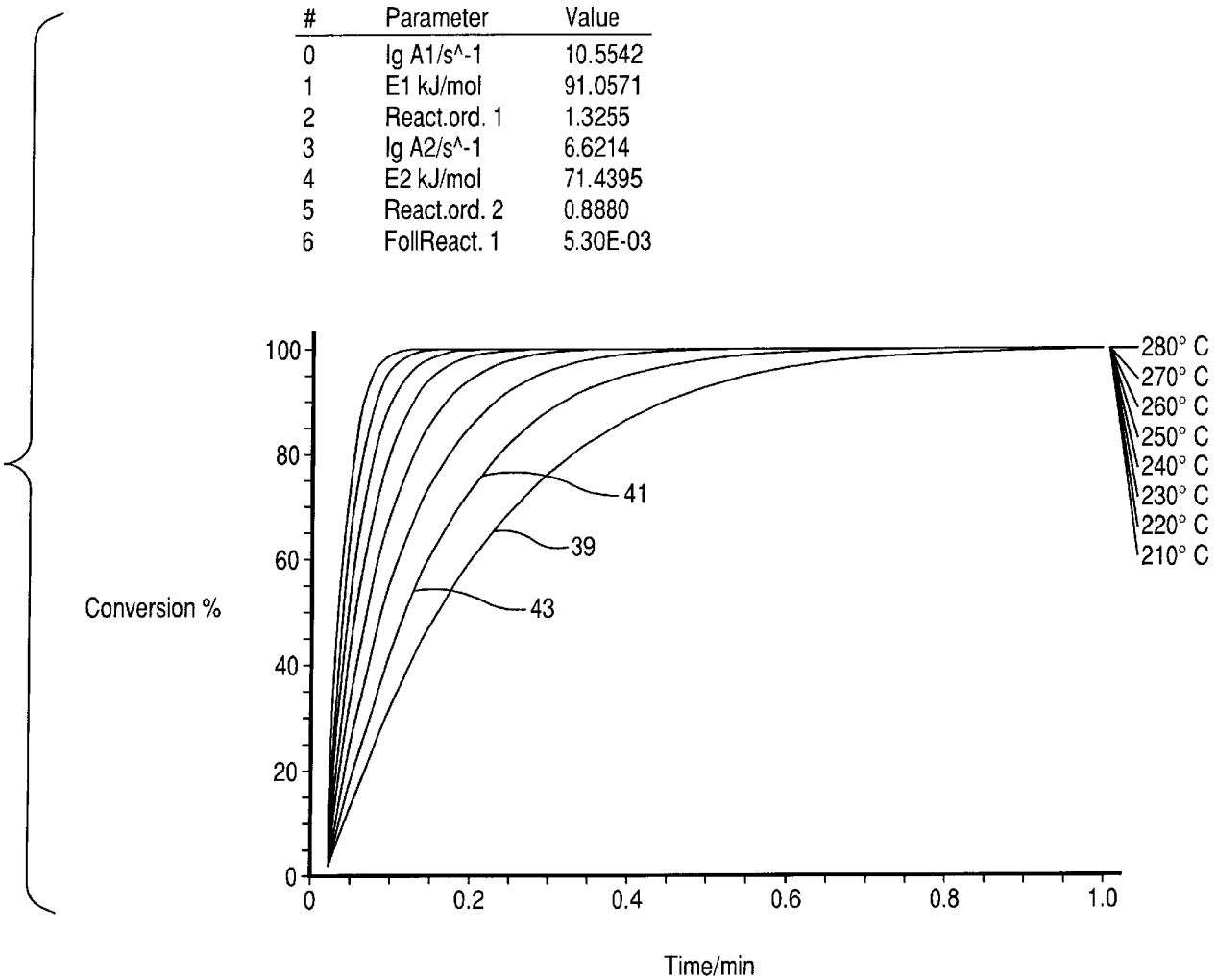
FIG. 4 is a graph illustrating that the cross-link conversion percentage (%) of thermoset powder material coated onto a sheet is a non-linear function of temperature and time.

Certain embodiments of this invention utilize the non-linear relationship between temperature and thermoset cross-linking conversion to achieve a final coated product having high gloss and reasonably smooth surface characteristics. FIG. 4 is a conversion percentage (%) versus time (minutes) versus temperature (degrees C.) graph illustrating that the conversion rate or percentage of thermoset powder coating material is a non-linear function of both temperature and time. For example, graph line 39 is representative of a thermoset coated steel sheet proceeding through an induction oven/furnace and heated to a temperature of 210° C., whereas line 41 is representative of the same type thermoset coated sheet going through an induction oven and heated to 220° C., line 43 being representative of the same type thermoset coated sheet proceeding through an induction oven and heated to a temperature of 230° C., and so on. The non-linear relationship between cross-linking conversion (i.e. the amount of thermoset cross-linking occurring) and temperature is clear.

It is pointed out that the temperatures illustrated herein in FIGS. 4–8 are the metal or substrate temperatures of underlying steel sheet upon which thermoset coating is applied. It may be presumed that the thermoset coating material is at least partially at approximately the same temperature(s) as the underlying sheet. Different types of sheets (e.g. metal vs. fabric) may be heated to different temperatures.

According to certain embodiments of this invention, this non-linear relationship is utilized to outgas the thermoset material in heating zone #1 when the conversion slope is at a relatively low (i.e. not particularly steep) first level, and thereafter to elevate the thermoset's temperature to a higher level to effect proper curing. This enables gas(es) and/or other volatile materials to exit the thermoset prior to final curing thereby achieving an improved final coated product.

Figure 5:
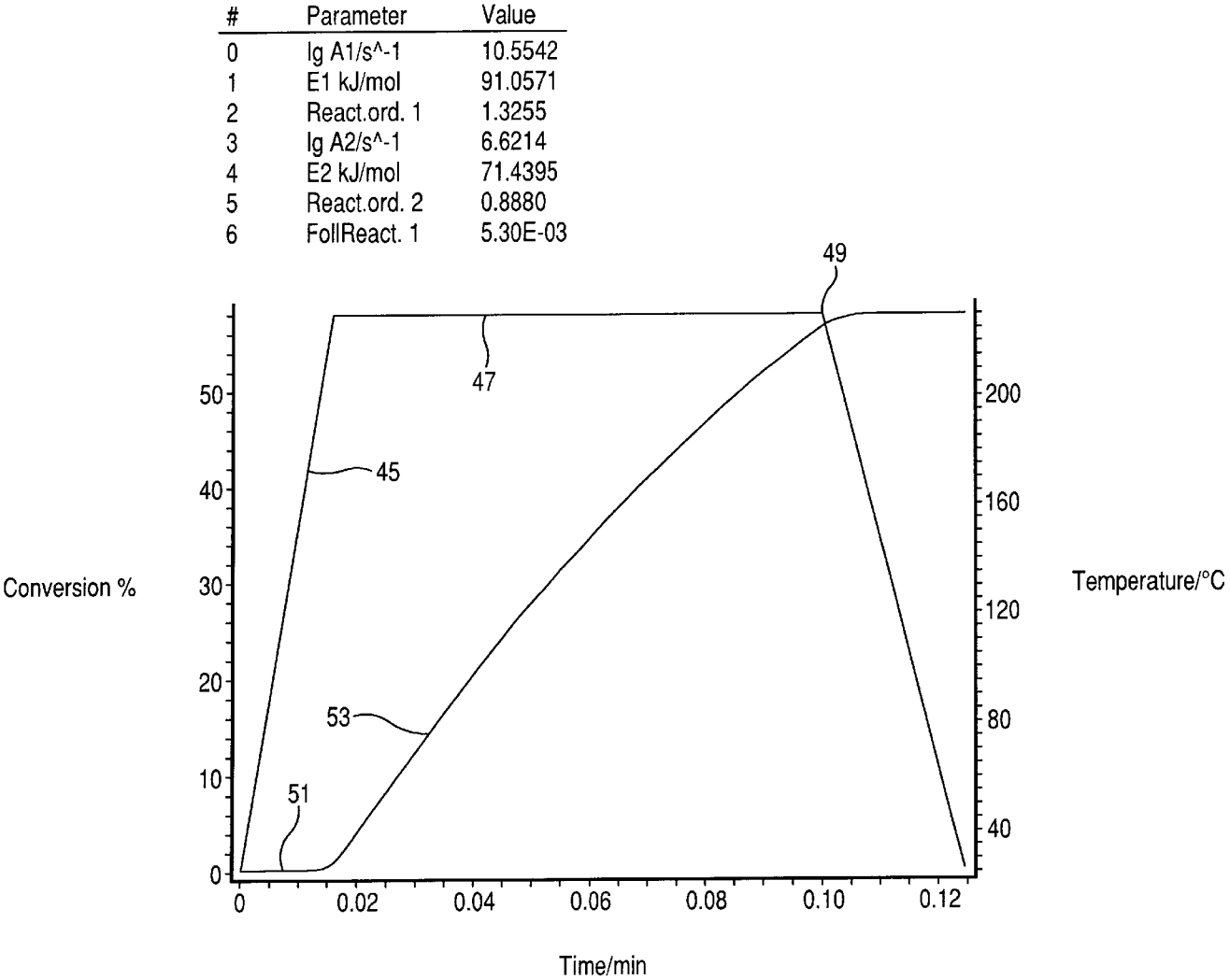
FIG. 5 is a graph illustrating the percent (%) cross-link conversion of thermoset powder material passed through an induction oven/furnace with the underlying sheet heated to a temperature of about 230° C., as a function of time.

FIG. 5 is a conversation (%) versus time (minutes) versus temperature (degrees C.) graph illustrating conversion rates of a powder thermoset material proceeding through an induction oven where the underlying metal sheet is heated to a temperature of 230° C. The coated sheet upon entering the oven is at a temperature of less than 40° C., but once therein quickly ramps up 45 to a temperature of approximately 230° C. This 230° temperature 47 of the coated sheet is maintained until point 49 when the coated sheet exits the oven and its temperature decreases as shown in FIG. 5. As the thermoset coated sheets temperature rises 45 and reaches approximately 230 degrees, the cross-link conversion percentage of the thermoset coating begins to rise 53, so that cross-linking continues as the heated thermoset proceeds through the oven. It is noted that cross-linking does not occur as soon as the coated article enters the oven, but instead only begins after the thermoset is heated to at least about 120 degrees C. After approximately 0.10 minutes (i.e. about 6 seconds) in the oven, approximately 50%–60% of the thermoset material has cross-linked as shown in FIG. 5, while much of the gases and other volatile materials therein have exited.

Figure 6:
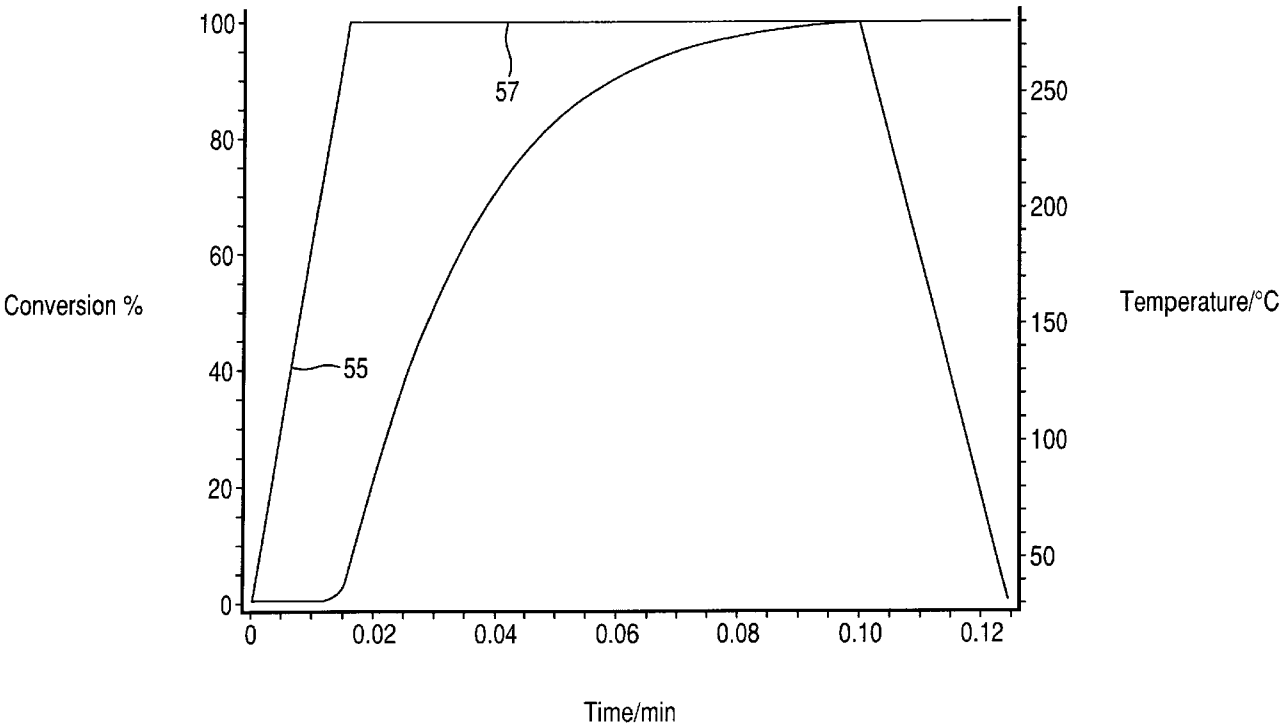
FIG. 6 is a graph similar to FIG. 5, except that the sheet underlying the thermoset material is heated to a temperature of about 280° C.

FIG. 6 illustrates that the conversion curve/rate over the same time period as utilized in FIG. 5 for thermoset cross-linking is significantly higher when the thermoset-coated sheet is heated to a higher temperature(s). As shown in FIG. 6, the coated sheet temperature ramps up 55 to approximately 280° C. at 57. This heightened temperature is maintained from about the 0.02 minute mark to approximately the 0.10 minute mark. As shown in FIG. 6, given this heightened temperature, almost 100% of the thermoset material has cross-linked by the time the coated strip has been in the oven for approximately 0.10 minutes. This conversion rate is much quicker than when the thermoset was only heated to the FIG. 5 temperature. If the thermoset (and sheet upon which it is applied) were initially quickly heated up to 280 degrees C. temperature with a single ramp-up as shown in FIG. 6, a significant amount of gas(es) and/or other volatile material would not be permitted to escape prior to this rapid final curing. Should the volatile materials not be permitted to escape, then the surface of the cured product will have a mottled appearance known as "orange peel." That surface will not have the high gloss that frequently is sought.

Figure 7:
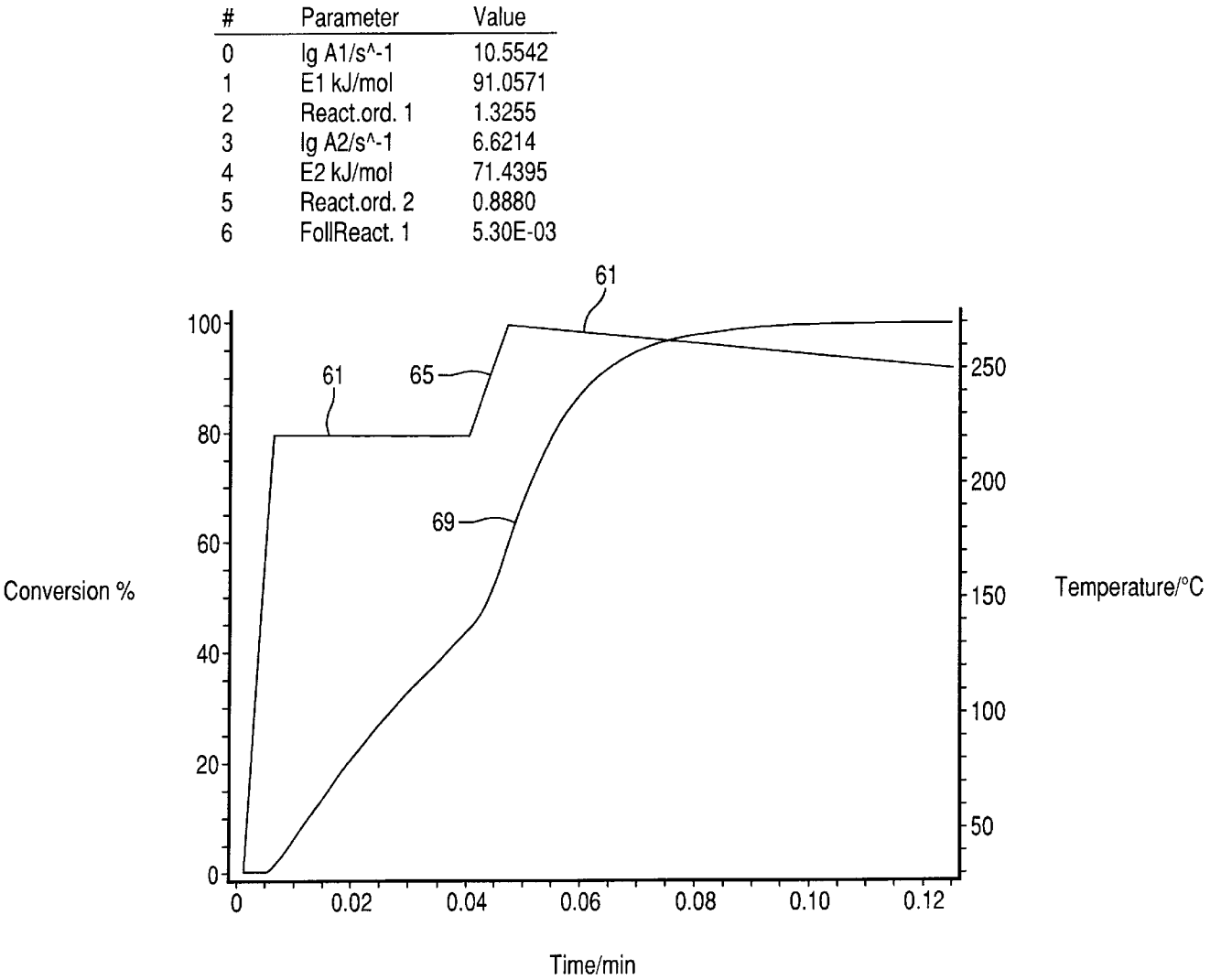
FIG. 7 is a graph illustrating a heating process performed by first and second induction ovens/furnaces on metal sheet/strip coated with thermoset powder material according to an embodiment of this invention, where the first oven heats the sheet to a first temperature and the second oven heats the sheet to a higher second temperature to effect curing.

Referring to FIGS. 2 and 7, an embodiment of this invention will be described. Initially, coil steel sheet, for example, is supplied and is to be continuously moved through the stations illustrated in FIG. 2. The sheet is conveyed into coating chamber/booth 23 where thermoset powder material is electrostatically deposited onto at least one major surface of the sheet. The coated sheet is then fed into first induction oven 25. As shown in FIG. 7, first oven 25 heats the thermoset-coated sheet to a temperature of approximately 220° C. (preferably to a temperature of from about 190 to 250 degrees C., and more preferably to a temperature of from about 210 to 230 degrees C.) as shown at 61. The temperature is sufficient to substantially melt the thermoset powder but not high enough to effect rapid or substantial cross linking of the powder. It takes approximately 0.10 minutes (i.e. about 6 seconds) for the coated sheet to travel through first oven 25, as illustrated in FIG. 7 (preferably from about 4–20 seconds). By the time the coated sheet reaches the end of the first heating zone (i.e. the end of first induction furnace/oven 25), from about 10%–65% thermoset cross-link conversion has occurred, more preferably from about 25%–60% conversion, and most preferably from about 40 to 55% conversion, as illustrated in FIG. 7. Line 69 in FIG. 7 illustrates the cross-linking curve/rate of the thermoset coating.

In certain preferred embodiments, as shown in FIG. 7, in first furnace 25, the thermoset's conversion % rises at a rate of less than about 55 percentage (%) points in any period of about 0.09 minutes, more preferably at a rate of less than about 50 percentage (%) points during the 0.09 minute period, and most preferably at a rate of less than or equal to about 45 percentage (%) points during the 0.09 minute period. This relatively slow rate allows outgassing of the thermoset to occur adequately prior to final curing.

The coated article (including partially cured thermoset coating) immediately enters second induction furnace 27 after leaving first furnace 25. Second furnace 27 ramps up 65 the temperature of the partially cured thermoset coated sheet to a temperature 63 greater than its temperature in the first furnace. Second furnace heats the thermoset coated sheet coating to a maximum temperature of from about 230°–290° C., more preferably to a maximum temperature of from about 260°–280° C., in order to finally cure the thermoset coating. As shown in FIG. 7 the cross-linking percentage of the thermoset rises from about 45% to at least about 95% in less than about 0.10 minutes in the second furnace due to the heightened temperatures (i.e. a much quicker conversion rate than in the first outgassing furnace).

In certain preferred embodiments, as shown in FIG. 7, in the second furnace 27, the thermoset's conversion % rises at a rate of at least about 35 percentage (%) points in any period of about 0.05 minutes (i.e. about 3 seconds). Preferably, the thermoset's conversion % rises in second furnace 27 at a rate of from about 35 to 60 percentage (%) points over a period of about 0.05 minutes (i.e. about 3 seconds), most preferably from about 40 to 50 percentage (%) points over that approximate 3 second time period. Thus, the thermoset conversion slope versus time is significantly steeper in second furnace 27 than in first furnace 25, as illustrated in FIG. 7.

In certain embodiments, second induction furnace 27 controls the thermoset's temperature so that it gradually decreases when therein as shown at 63 in FIG. 7. Eventually, the coated sheet's temperature may decline in the second furnace to from about 240°–260° C., preferably about 250 degrees C., as illustrated in FIG. 7.

By the time the coated articles leaves the second oven, at least 90% of the thermoset material has cross-linked, most preferably almost 100% as shown in FIG. 7. The increase 69 in conversion rate caused by the heightened thermoset temperatures in the second furnace enables gasses and other volatile materials to escape from the thermoset material as it is proceeding through first furnace 25 at lower temperatures, prior to final curing. The first and second heating zones at different temperatures allow cross-linking to start off slowly, and then increase in rate after significant outgassing and once the coated article enters the second heating zone.

In certain preferred embodiments of this invention, the conveyor upon which the coated article is continuously moved travels at a rate of from about 200–600 ft. per second, more preferably at a rate of from about 250–600 ft. per second, and most preferably at a rate of from about 300–500 ft. per second. Quicker conveyor rates are achievable with the use of the dual back-to-back induction ovens or heating zones as described herein.

Figure 8:
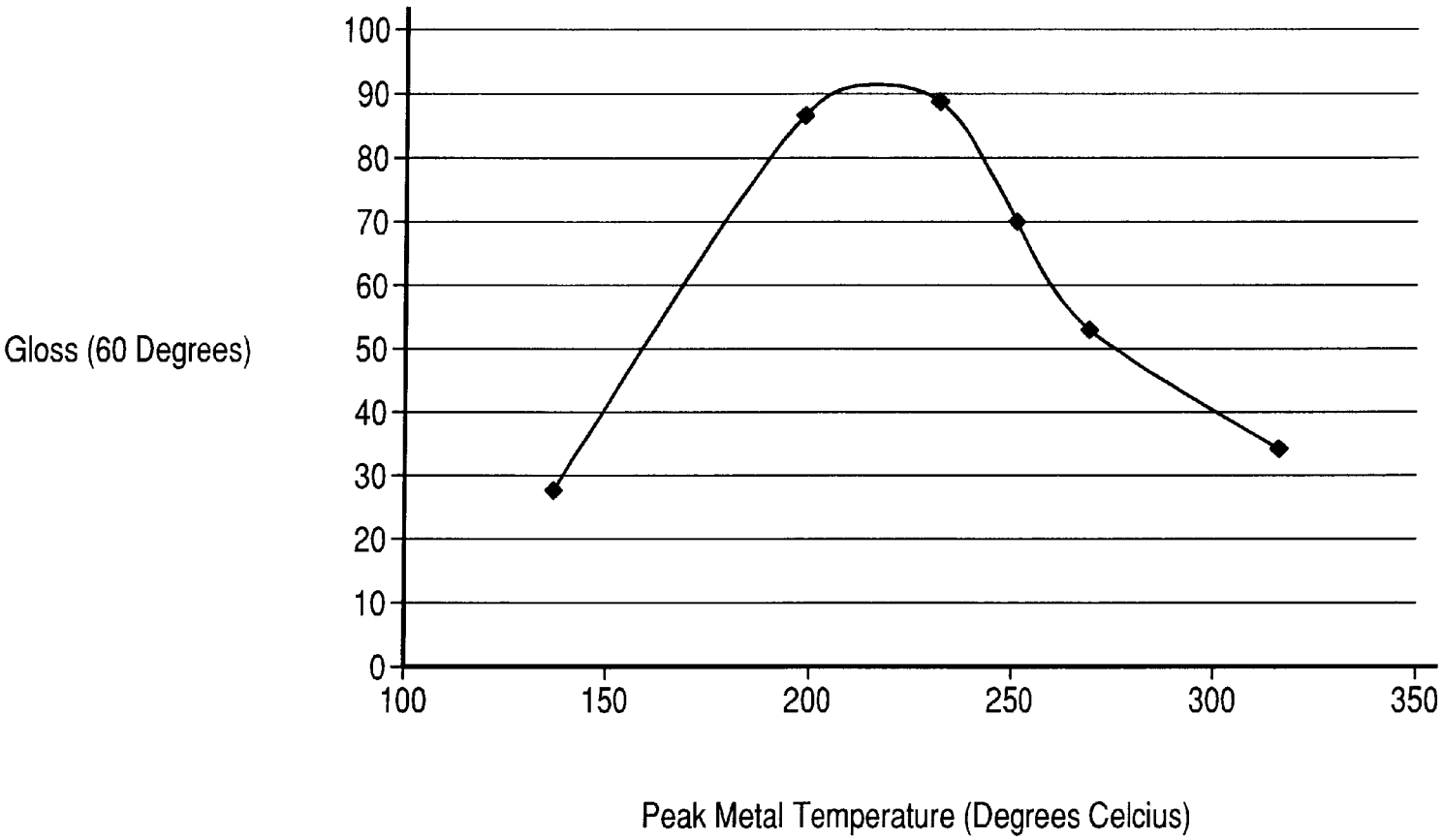
FIG. 8 is a gloss (60 degrees) versus peak metal temperature (degrees C.) graph illustrating that coated product gloss is a function of peak temperature of the underlying sheet and/or thermoset.

FIG. 8 illustrates that gloss is a function of peak thermoset and/or peak underlying sheet temperature. Thus, the peak sheet metal temperature may be controlled in the second furnace so that optimum gloss levels are achieved, pursuant to ASTM Standard D 523, DIN 67 530, ISO 2813. The measurements of FIG. 8 were taken with 10-inch wide sheet steel, 0.28 inches thick, on the line coated with Herbert's Appliance White thermoset. Gloss data was measured using a BYK Gardner Micro Tri-Gloss Model, 4520, at 60 degree angle(s). The optimum peak temperature is material specific, and thus varies as a function of the underlying sheet material and the thermoset material. For example, the optimum maximum sheet metal temperature for the materials used in FIG. 7 was approximately 270 degrees C. (i.e. 270° C. ±10°).

In certain embodiments of this invention, a fast curing catalyst may be provided within the thermoset material. The catalyst may be chosen so that it does not begin to significantly increase cross-linking from what it otherwise would have been until the temperatures achieved in furnace 27 are realized by the coated article traveling therethrough.

Furnaces 25 and 27 are preferably induction-type furnaces according to certain embodiments of this invention. These induction furnaces/ovens may be of any type shown/described in any of U.S. Pat. Nos. 5,901,170, 5,578,233, 5,469,461, 5,472,528, the disclosures of which are all hereby incorporated herein by reference, or any other type of known induction furnace. Induction furnaces enable precise temperature control of the thermoset and underlying sheet by fine-tuning of current/voltage supplied to the furnace coils. Phase modulation of current supplied to furnaces 25 and 27 may also be utilized to fine-tune temperatures. Temperature control in induction-type furnaces is superior to temperature control in convection ovens and IR ovens, for example.

Once given the above disclosure, many other features, modifications, and improvements will become apparent to the skilled artisan. Such other features, modifications, and improvements are, therefore, considered to be a part of this invention, the scope of which is to be determined by the following claims.

We claim:

1. A method of making a coated article, comprising the steps of:

electrostatically applying a thermoset powder coating onto at least one major surface of a continuously moving substrate thereby providing a thermoset coated substrate;

moving the thermoset coated substrate into a first oven and heating the thermoset powder coating to a first temperature in the first oven sufficient to melt the thermoset powder and to effect cross-linking conversion of the thermoset powder at a first rate which permits degassing, and thereafter removing the coated substrate from the first oven;

ceasing the application of additional heating of the thermoset powder for a predetermined period sufficient to permit the thermoset powder to degas;

moving the thermoset coated substrate into a second oven, and heating the thermoset coating to a second temperature in the second oven sufficient to effect cross-linking conversion of the thermoset powder coating at a second rate that is faster than the first rate to achieve curing, wherein the second temperature is higher than the first temperature; and moving the substrate with cured thermoset coating thereon from the second oven to a quenching area for quenching.

2. The method of claim 1, including the step of providing the first and second ovens from the group consisting of induction ovens and infrared ovens.

3. The method of claim 2, wherein the first and second ovens are induction ovens.

4. The method of claim 3, further comprising the step of heating the thermoset coating to a temperature in the second induction oven that is at least 30 degrees C. higher than a maximum temperature to which the thermoset coating is heated in the first induction oven.

5. The method of claim 1, wherein said electrostatically applying step includes applying the coating directly onto the at least one major surface of the substrate.

6. The method of claim 1, wherein the first temperature is from about 210 to 230 degrees C., and the second temperature is from about 260 to 280 degrees C.

7. The method of claim 1, wherein said step of heating the thermoset coating to a second temperature in the second oven includes causing cross linking percentage of the thermoset coating to rise from about 45% to at least about 95% in the second oven in less than about 0.10 minutes.

8. The method of claim 1, wherein said step of heating the thermoset coating to a second temperature in the second oven includes causing cross linking percentage of the thermoset coating to rise at a rate of at least about 35 percentage points during a period of about 0.05 minutes.

9. The method of claim 8, wherein said step of heating the thermoset coating to a second temperature in the second oven includes causing cross linking percentage of the thermoset coating to rise in the second oven at a rate of from about 35 to 60 percentage points during the period of about 0.05 minutes.

10. The method of claim 8, wherein said step of heating the thermoset coating to a second temperature in the second oven includes causing cross linking percentage of the thermoset coating to rise in the second oven at a rate of from about 40 to 50 percentage points during the period of about 0.05 minutes.

11. A method of making a coated article, comprising the steps of:

electrostatically applying a thermoset powder coating onto at least one major surface of a continuously moving sheet thereby providing a thermoset coated sheet;

moving the thermoset coated sheet into a first induction oven and heating the thermoset powder coating thereon to a first temperature in the first induction oven to melt the thermoset powder and achieve a first rate of thermoset cross linking conversion of the thermoset powder which permits degassing, and thereafter removing the thermoset coated sheet from the first induction oven;

ceasing the application of heating the thermoset powder coating for a predetermined period sufficient to permit the thermoset powder coating to degas;

moving the thermoset coated sheet into a second induction oven, and heating the thermoset coating thereon to a second temperature in the second induction oven to achieve a second rate of thermoset cross-linking conversion of the thermoset powder, wherein the second rate is higher than the first rate and the second temperature is higher than the first temperature, thereby curing the thermoset coating in the second induction oven.

12. The method of claim 11, further comprising the step of heating the sheet to a temperature in the second induction oven that is at least 30 degrees C. higher than a maximum temperature to which the sheet is heated in the first induction oven.

13. The method of claim 11, wherein said electrostatically applying step includes applying the coating directly onto the at least one major surface of the sheet.

* * * * *